US007611028B2

(12) United States Patent
Desico et al.

(10) Patent No.: US 7,611,028 B2
(45) Date of Patent: Nov. 3, 2009

(54) PLASTIC CONTAINER INCLUDING HANDLE PORTIONS

(75) Inventors: Anthony Desico, Rochester Hills, MI (US); Gary I. Voss, Medina, OH (US); James J. Miller, Barberton, OH (US)

(73) Assignee: Plastipak Packaging, Inc., Plymouth, MI (US)

( * ) Notice: Subject to any disclaimer, the term of this patent is extended or adjusted under 35 U.S.C. 154(b) by 299 days.

(21) Appl. No.: 11/386,874

(22) Filed: Mar. 22, 2006

(65) Prior Publication Data

US 2008/0047925 A1 Feb. 28, 2008

Related U.S. Application Data

(63) Continuation-in-part of application No. 29/251,753, filed on Jan. 12, 2006, now Pat. No. Des. 528,922.

(51) Int. Cl.
*B65D 23/10* (2006.01)

(52) U.S. Cl. ..... 215/398; 220/771; 220/772

(58) Field of Classification Search ..... 215/384, 215/385, 398; 220/772, 771; D9/528, 530, D9/531, 533

See application file for complete search history.

(56) References Cited

U.S. PATENT DOCUMENTS

D198,484 S * 6/1964 Busch ..... D6/326
3,443,710 A * 5/1969 Hills ..... 215/385
3,537,498 A * 11/1970 St. Amand ..... 604/403
D237,464 S * 11/1975 Cipbers ..... D23/211.1
4,279,349 A * 7/1981 Aigner ..... 215/6
4,765,514 A * 8/1988 Berglund ..... 222/145.1
4,813,556 A * 3/1989 Lawrence ..... 215/11.3
4,856,685 A * 8/1989 Gaffney ..... 222/454
D304,806 S * 11/1989 Mednis ..... D9/520
5,226,550 A * 7/1993 Mikolaitis et al. ..... 215/384
5,305,910 A * 4/1994 Pollacco ..... 220/771
D388,698 S * 1/1998 Newsom ..... D9/742
D436,376 S * 1/2001 Regan et al. ..... D19/66
D499,340 S * 12/2004 Evans et al. ..... D9/528
D508,651 S * 8/2005 Harrell et al. ..... D9/531
D516,918 S * 3/2006 Leslie et al. ..... D9/528
D517,413 S * 3/2006 Murphy ..... D9/522

* cited by examiner

*Primary Examiner*—Sue A Weaver
(74) *Attorney, Agent, or Firm*—Dykema Gossett PLLC

(57) ABSTRACT

The plastic container includes a hollow body of plastic material having a lower supporting base, a sidewall extending upwardly from the base, a shoulder extending upwardly from the sidewall, and an upper neck portion with an opening therein extending upwardly from the shoulder. The sidewall includes two handle portions on opposed sides thereof, and the neck portion is generally centrally located, whereby, the contents of the container can be dispensed by holding either of the handle portions.

10 Claims, 6 Drawing Sheets

PLASTIC CONTAINER INCLUDING HANDLE PORTIONS

CROSS-REFERENCE TO RELATED APPLICATIONS

This application is a continuation-in-part of U.S. patent application Ser. No. 29/251,753, filed Jan. 12, 2006 now U.S. Pat. No. D528,922.

BACKGROUND OF THE INVENTION

Plastic containers are widely used commercially for a variety of products. These include plastic containers of widely varying sizes depending on the particular product and the commercial needs. Naturally, from the point of view of the consumer it is highly desirable to be able to conveniently dispense product from the container, especially for liquid products in larger size plastic containers. The plastic container should be easy to handle and use and should also be attractive for home or commercial use.

Accordingly, it is a principal object of the present invention to provide a plastic container which is easy to handle and use.

It is a further object of the present invention to provide a plastic container as aforesaid which enables the user to conveniently dispense product therefrom, especially in large size containers.

It is a still further objective of the present invention to provide a plastic container as aforesaid which has desirable commercial features and pleasing aesthetic characteristics.

It is an additional objective of the present invention to provide a plastic container as aforesaid which is easy to use, easy to handle and easy to pour from, especially in large size containers.

Further objects and advantages of the present invention will appear hereinbelow.

SUMMARY OF THE INVENTION

In accordance with the present invention the foregoing objects and advantages are readily obtained.

The plastic container of the present invention comprises:

a hollow body of plastic material having a lower supporting base, a sidewall extending upwardly from the base, a shoulder portion extending upwardly from the sidewall, and an upper neck portion with an opening therein extending upwardly from the shoulder portion;

wherein, the sidewall includes two handle portions on opposed sides thereof and the neck portion is generally centrally located above the shoulder portion, whereby the contents of the container can be dispensed by holding either of the handle portions.

The container preferably has a rectangular configuration with two longer sidewall section which alternate with two shorter sidewall sections. The handle portions are preferably located on opposed sidewall sections.

The shoulder portion preferably extends upwardly and slopes inwardly between the sidewall and neck portion. The neck portion is a relatively larger neck portion which extends upwardly for preferably 1.5 to 3 inches in length. The sloped shoulders allows one to get closer to the receptacle and the longer neck provides clearance with most obstacles, for example, in use under the hood of an automobile. The two handle portions provide the ability to dispense from the container from either handle, or from both handles if desired. Moreover, the present container is particularly convenient in a larger size container, as a container of at least four quarts and preferably from four to eight quarts.

Further features of the present invention will appear hereinbelow.

BRIEF DESCRIPTION OF THE DRAWINGS

The present invention will be more readily understandable from a consideration of the following illustrative drawings, wherein.

DETAILED DESCRIPTION OF PREFERRED EMBODIMENTS

Figure 1:
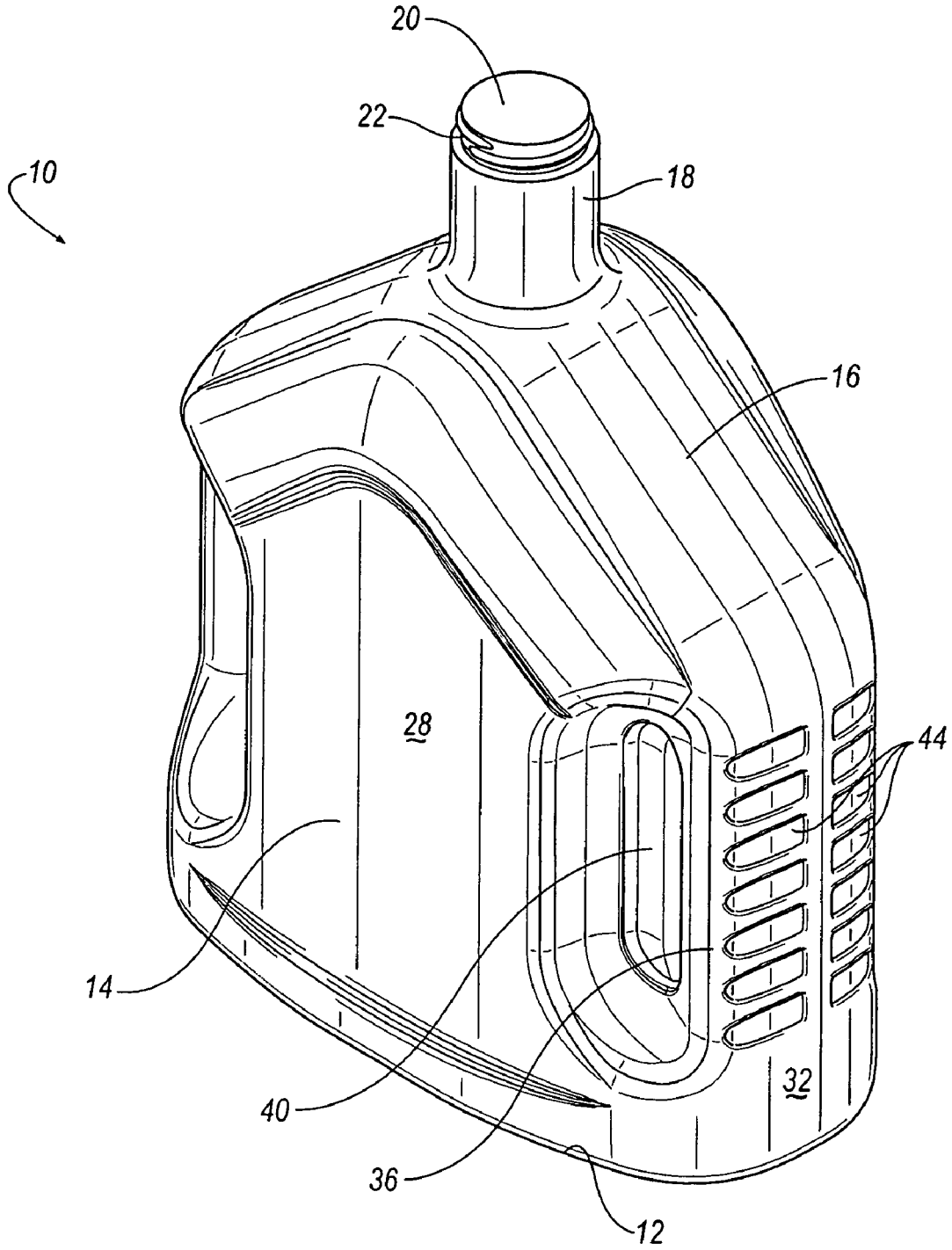
FIG. 1 is a perspective view of a plastic container of the present invention showing the front, top and left side thereof.
Figure 2:
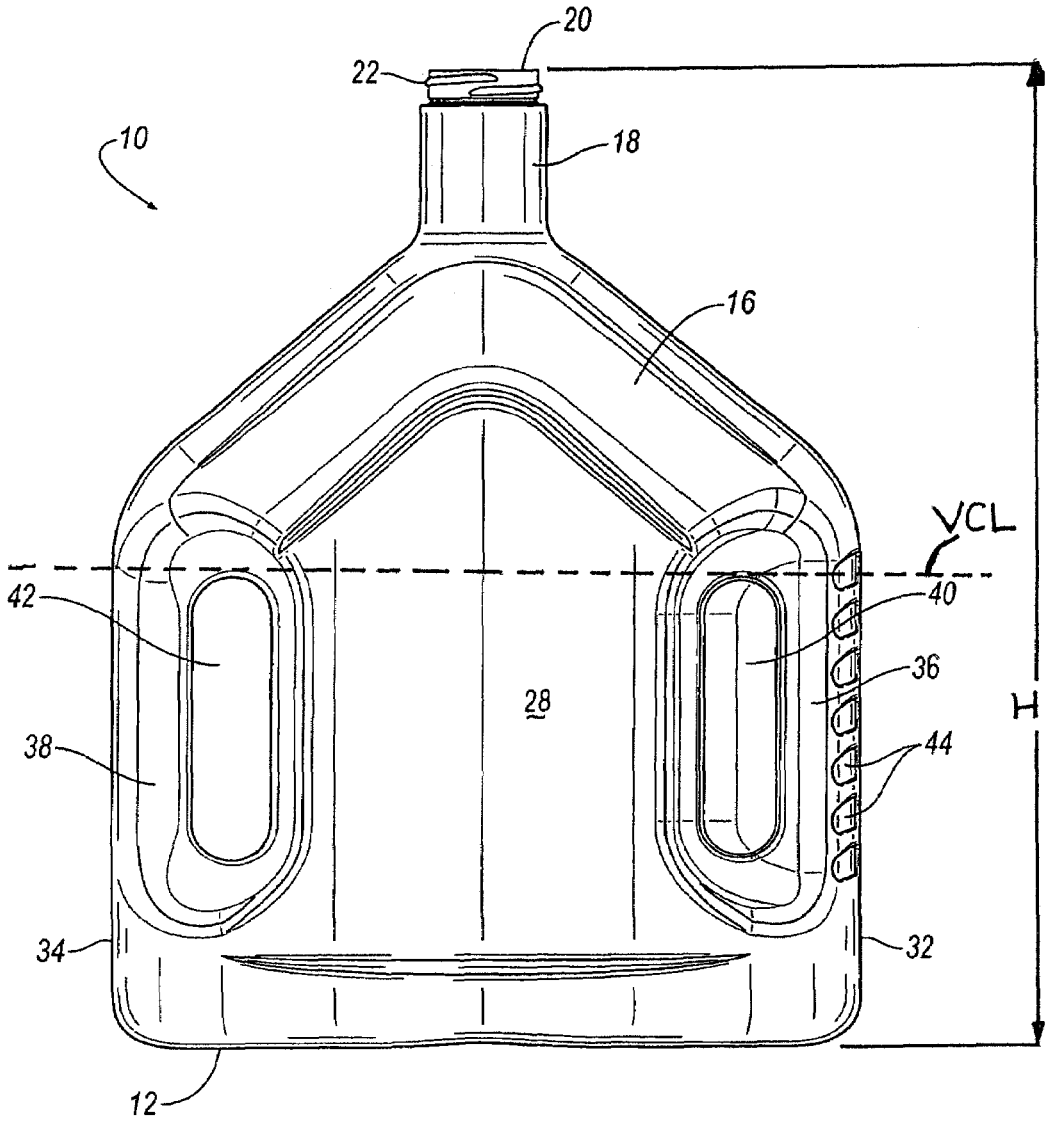
FIG. 2 is a side elevation view thereof showing the left side.
Figure 3:
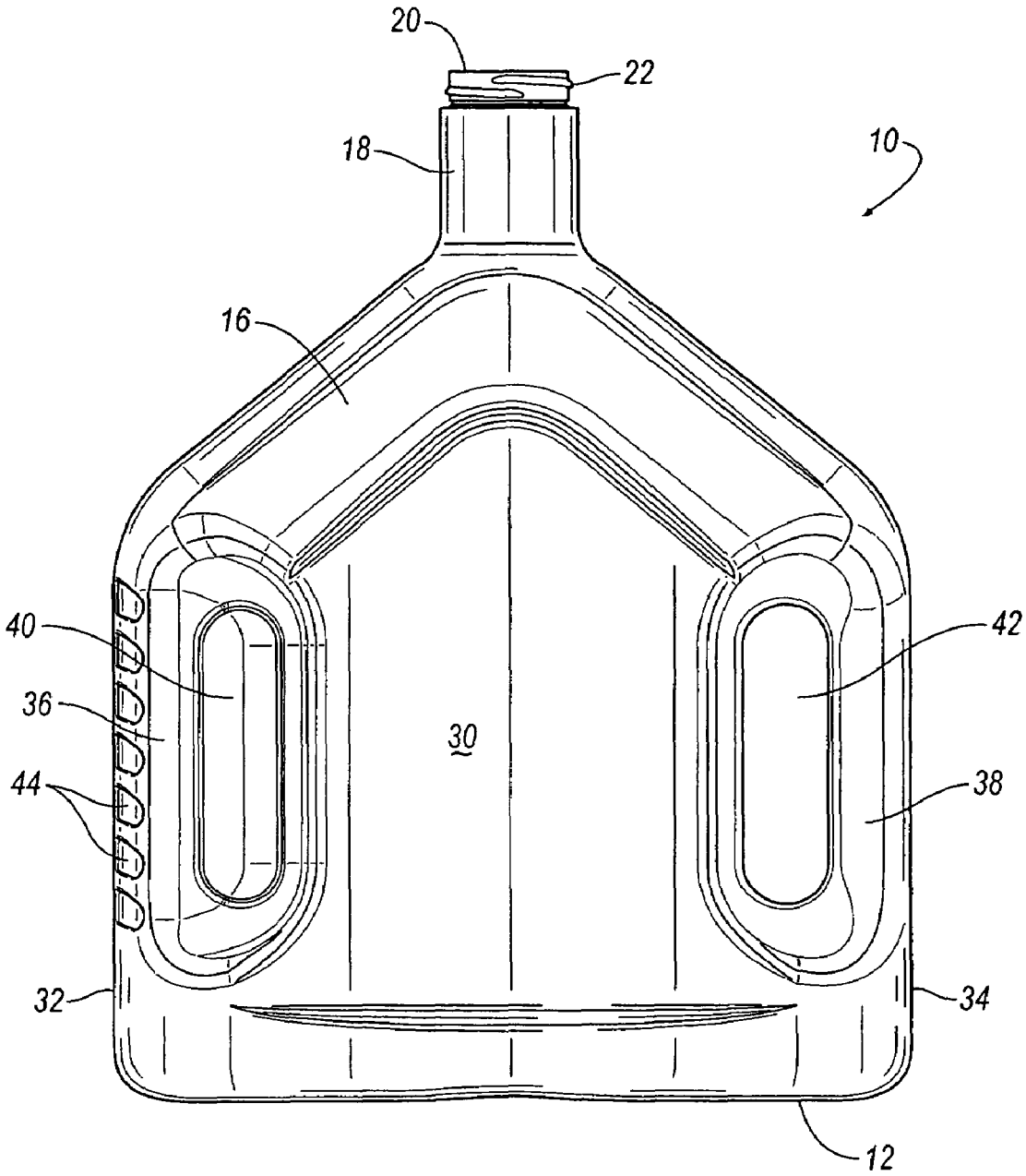
FIG. 3 is a side elevation view thereof showing the right side.
Figure 4:
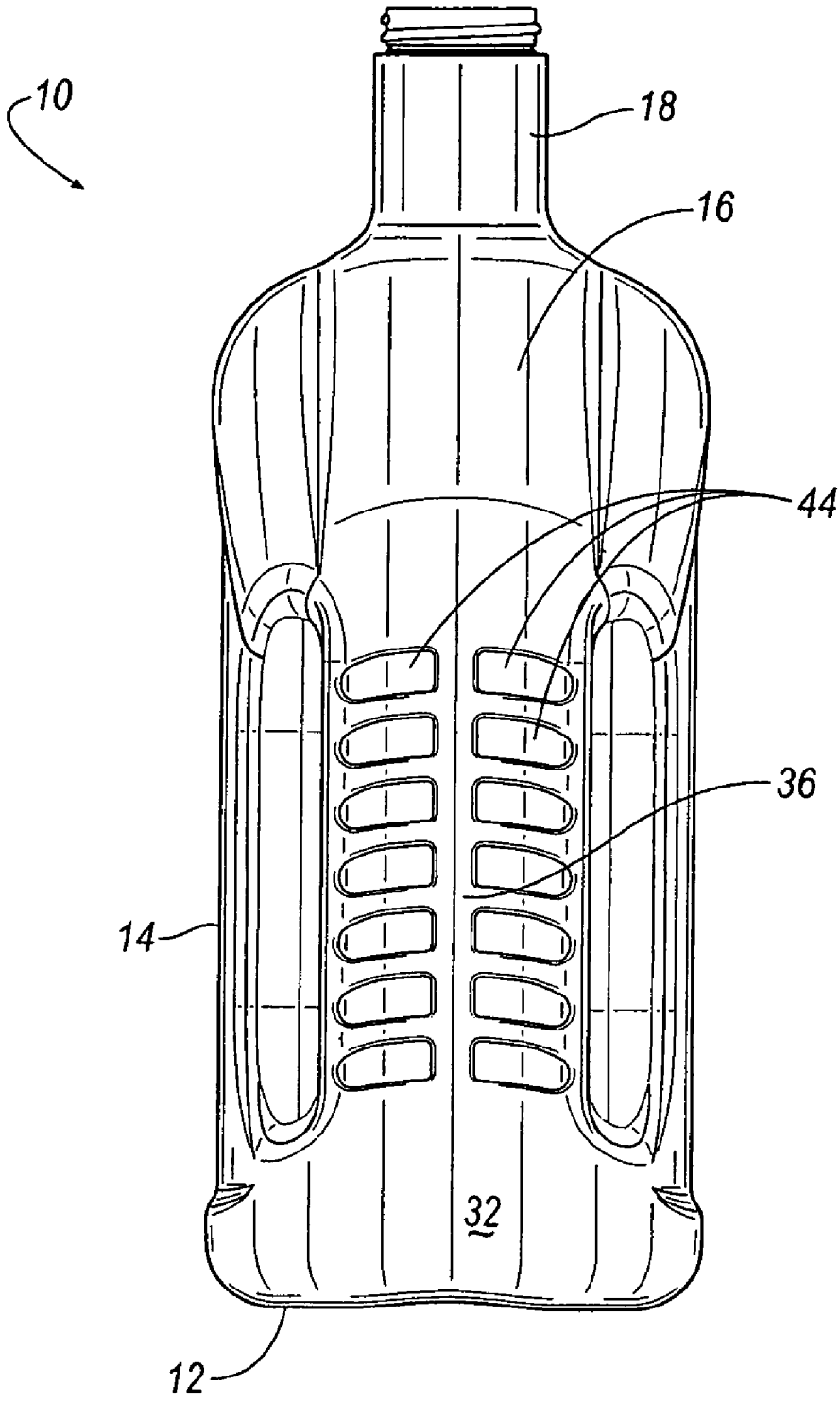
FIG. 4 is a side elevation view thereof showing the front.
Figure 5:
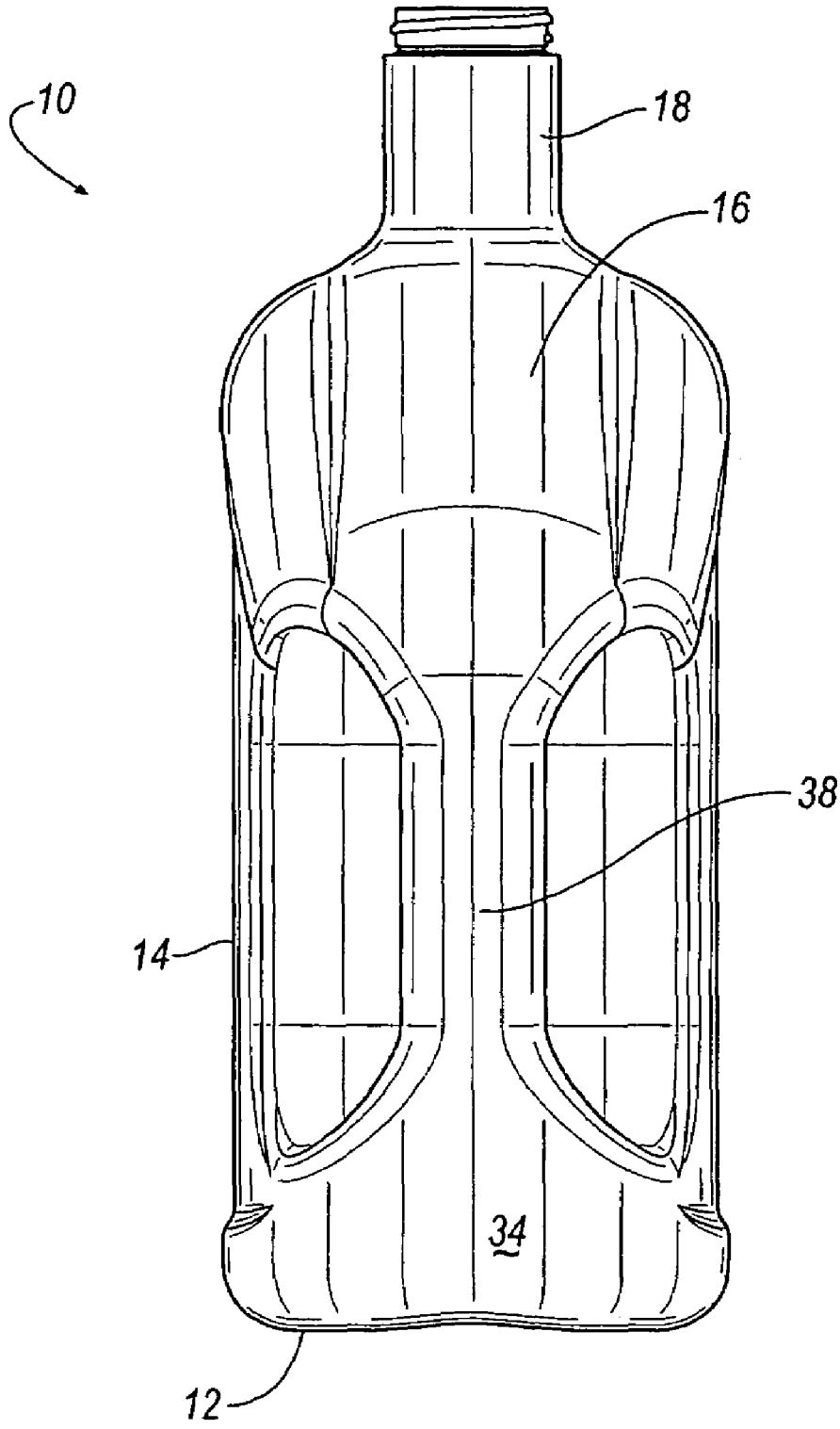
FIG. 5 is a side elevation view thereof showing the rear.
Figure 6:
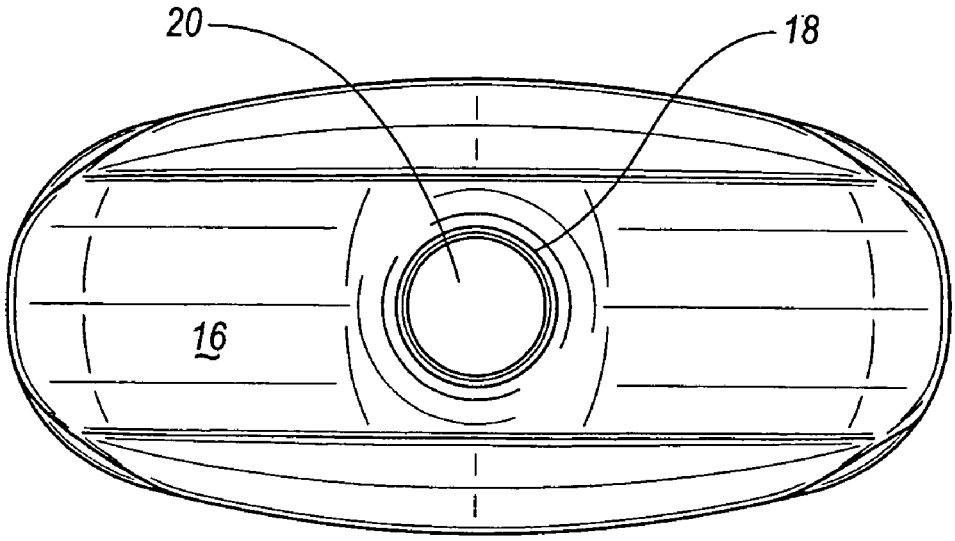
FIG. 6 is a top plan view thereof.

Referring to the drawings, FIGS. 1-7 show a preferred embodiment of the plastic container of the present invention. Plastic container 10 has a lower supporting base 12, a sidewall 14 extending upwardly from the base, shoulder 16 extending upwardly and inwardly from the sidewall, and an upper neck portion 18 with an opening 20 therein extending upwardly from the shoulder. The neck portion preferably includes outer threads 22 suitable for holding a screw-threaded closure (not shown), and opening 20 provides access to the hollow interior of the container for filling the container and dispensing product therefrom. With reference to FIG. 2, the illustrated container 10 has a vertical height H, and a vertical centerline VCL that is provided at approximately one-half of the vertical height H of the container 10.

Figure 7:
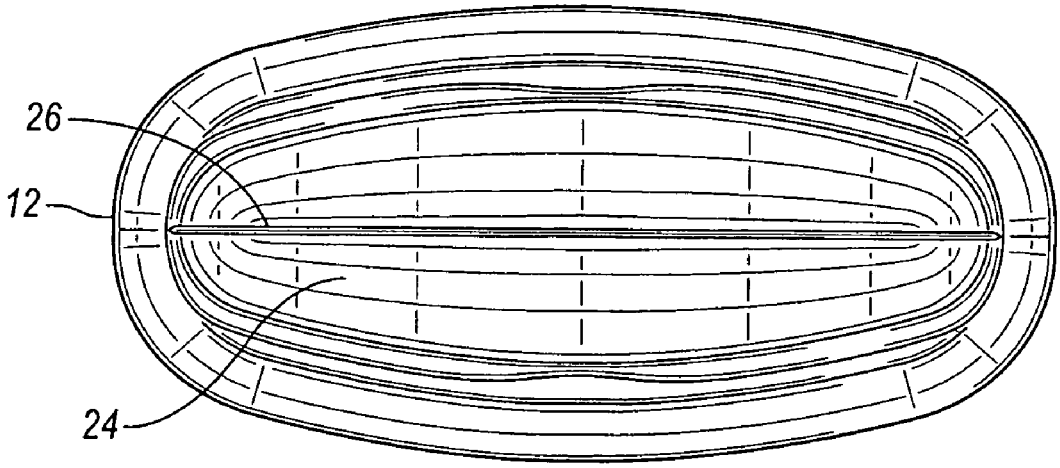
FIG. 7 is a bottom plan view thereof.

The base 12 configuration, shown in FIG. 7, is not critical, and may have a recessed central portion 24 and a central strut 26 for stability.

The container of the present invention desirably has a capacity of at least four quarts, and preferably from four to eight quarts.

Preferably also the container 10 has a rectangular configuration with longer sidewall portions 28, 30 which alternate with shorter sidewall portions 32, 34. The longer sidewall portions may serve as label panels. Shorter sidewall portion 32 may be considered the front sidewall portion, shorter sidewall portion 34 may be considered the rear sidewall portion, longer sidewall portion 28 may be considered the left sidewall portion, and longer sidewall portion 30 may be considered the right sidewall portion. While the embodiment shape shown in the drawings is preferred, the container may have other shapes if desired, as for example a generally square shape or a generally round shape.

The shoulder portion 16 extends upwardly from the sidewall portion 14 and slopes inwardly between the sidewall 14 and neck portion 18. The neck portion 18 is generally centrally located above the shoulder portion and extends upwardly above the shoulder portion. The neck portion 18 has a generally long and straight configuration, preferably extending upwards for from 1.5 to 3 inches. The longer neck configuration allows for clearance with most obstacles and permits convenient dispensing of the contents of the container.

The sidewall 14 includes two handle portions 36,38 on opposed sides of the container. Handle portion 36 is on the front sidewall portion 32 and is the front handle portion, and handle portion 38 is on the rear sidewall portion 34 and is the rear handle portion. Handle portions 36, 38 each include a through opening 40, 42, respectively, beneath the handle portions, which provides a convenient hand grip on opposed sides of the container. Naturally, other handle configurations may be readily employed. In addition, hand grip means 44 are preferably provided on at least one of the shorter sidewall portions adjacent the handle portion to facilitate holding, as a plurality of outward protrusions 44 on front sidewall portion 32 adjacent front handle portion 36. In the embodiment shown in the drawings, these are a plurality of spaced apart outward protrusions 44 along the front sidewall portion. Naturally, if desired these can be provided on both the front sidewall portion 32 as shown and the rear sidewall portion 34, and the spacing, size and number of the outward protrusions can be readily varied.

Any desirable plastic material can be used, such as for example polyethylene terephthalate.

Thus, it can be readily seen that the container of the present invention is particularly convenient to use, especially in the larger sizes. The two handles on opposed sides provides the ability to conveniently dispense product while holding by either handle. The centrally located neck portion makes this particularly easy to do. Moreover, the sloped shoulders allows the container to get closer to the product receptacle. In addition, the longer neck portion provides clearance for most obstacles in the product dispensing operation. As an additional advantageous feature, when the container is substantially inverted in a generally upside down orientation to dispense product into a receptacle, the container should be able to "stand-up" on its own with support from the receptacle while the contents empty. The longer neck portion and sloped shoulders provide support.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A plastic container, which comprises:

a hollow body of plastic material having a lower supporting base, a sidewall extending upwardly from the base, a shoulder extending upwardly from the sidewall, and an upper neck portion with an opening therein extending upwardly from the shoulder, the shoulder extending upwardly along a substantial portion of the vertical distance of the upper one-half of the container and extending inwardly between the sidewall and neck portion;

wherein the container has a rectangular configuration with two longer sidewall portions that alternate with two opposing shorter sidewall portions, the opposing shorter sidewall portions each including a handle portion substantially located solely in the lower one-half of the container and comprising a through opening; each of the handle portions includes a hand grip comprising a plurality of outward protrusions on the outer side of the handle portion; and the neck portion is generally centrally located above the shoulder portion, whereby the contents of the container can be dispensed by holding either of the handle portions.

2. A container according to claim 1, wherein the neck portion extends upwardly for from 1.5 to 3 inches.

3. A container according to claim 1, having a capacity of at least 4 quarts.

4. A container according to claim 3, having a capacity of from 4 to 8 quarts.

5. A container according to claim 1, wherein the handle portions extend substantially along the vertical extent of each of the opposing shorter sidewall portions.

6. A container according to claim 1, wherein the plurality of outward protrusions on the outer side of the handle portion are spaced apart.

7. A container according to claim 1, wherein the shoulder extends continuously upward from the sidewall to the neck portion from each of the opposing shorter sidewall portions and slopes inwardly between each of the shorter sidewall portions.

8. A container according to claim 7, including two shoulder portions, each of which extends upwardly on the upper one-half of the container and at approximately the same upward angle.

9. A container according to claim 8, wherein the two shoulder portions extend upwardly and inwardly along the upper one-half of the container.

10. A container according to claim 1, wherein each handle portion is located entirely in the lower one-half of the container.

* * * * *